US010501159B2

(12) United States Patent
Frühling et al.

(10) Patent No.: US 10,501,159 B2
(45) Date of Patent: Dec. 10, 2019

(54) CARRYING OUT REMOTE CONTROLLED UNDERWATER WORKS

(71) Applicants: THYSSENKRUPP MARINE SYSTEMS GMBH, Kiel (DE); thyssenkrupp AG, Essen (DE)

(72) Inventors: Christian Frühling, Kiel (DE); Hendrik Brandt, Schönkirchen (DE); Axel Panoch, Bordesholm (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/741,833

(22) PCT Filed: Jul. 13, 2016

(86) PCT No.: PCT/EP2016/066608
§ 371 (c)(1),
(2) Date: Jan. 4, 2018

(87) PCT Pub. No.: WO2017/009367
PCT Pub. Date: Jan. 19, 2017

(65) Prior Publication Data

US 2018/0194446 A1 Jul. 12, 2018

(30) Foreign Application Priority Data

Jul. 15, 2015 (DE) ..... 10 2015 213 293

(51) Int. Cl.
*B63G 8/00* (2006.01)
*B63H 25/42* (2006.01)

(52) U.S. Cl.
CPC ..... *B63G 8/001* (2013.01); *B63H 25/42* (2013.01); *B63G 2008/002* (2013.01); *B63G 2008/004* (2013.01); *B63G 2008/007* (2013.01)

(58) Field of Classification Search
CPC .. B63G 8/00; B63G 8/001; B63G 8/41; B63C 11/00; B63C 11/42; B63C 11/52;
(Continued)

(56) References Cited

U.S. PATENT DOCUMENTS 3,621,911 A 11/1971 Baker
6,167,831 B1 1/2001 Watt
(Continued)

FOREIGN PATENT DOCUMENTS

WO 2014180590 A 11/2014
WO 2015049678 A 4/2015

OTHER PUBLICATIONS

English Translation of International Search Report issued in PCT/EP2016/066608, dated Sep. 29, 2016 (dated Oct. 7, 2016).
(Continued)

*Primary Examiner* — Lars A Olson
(74) *Attorney, Agent, or Firm* — thyssenkrupp North America, Inc.

(57) ABSTRACT

An unmanned underwater vehicle may comprise a remotely operated underwater vehicle and an autonomously operating underwater vehicle. The unmanned underwater vehicle may also comprise a first connection to the remotely operated underwater vehicle. The first connection may serve to exchange data. The unmanned underwater vehicle may additionally comprise a second connection to the remotely operated underwater vehicle. The second connection may serve to supply energy. The unmanned underwater vehicle may still further include a third connection to the autonomously operating underwater vehicle, which third connection serves to exchange data. A method for executing remotely controlled underwater works may involve dispatching such an unmanned underwater vehicle, decoupling and moving the autonomously operating underwater vehicle, establishing a connection between a first interface of the autonomously operating underwater vehicle and a second interface, setting up a data connection between a control center and the remotely operated underwater vehicle, and executing the underwater works.

12 Claims, 2 Drawing Sheets

(58) Field of Classification Search
CPC ..... B63B 27/00; B63B 27/16; B63B 27/36; B63H 25/42
USPC ..... 114/312, 321, 322
See application file for complete search history.

(56) References Cited

U.S. PATENT DOCUMENTS

| | | | | |
|---|---|---|---|---|
| 6,260,504 | B1 | 7/2001 | Moles | |
| 6,854,410 | B1 | 2/2005 | King | |
| 7,814,856 | B1 | 10/2010 | Smith | |
| 7,926,438 | B2 * | 4/2011 | Guerrero | B63G 8/001 114/312 |
| 2009/0114140 | A1 | 5/2009 | Guerrero | |
| 2010/0247244 | A1 | 9/2010 | Ansay | |
| 2015/0112513 | A1 | 4/2015 | Kerins | |

OTHER PUBLICATIONS

Saab, Sabertooth Versatility in New Dimensions, (https://www.saabseaeye.com/uploads/seaeye_sabertooth_rev_3_(1).pdf, (2014).
Saab Seaeye Sabertooth, Saab Seaeye Ltd. & Saab North America, Inc., (2014).

* cited by examiner

CARRYING OUT REMOTE CONTROLLED UNDERWATER WORKS

CROSS REFERENCE TO RELATED APPLICATIONS

This application is a U.S. National Stage Entry of International Patent Application Serial Number PCT/EP2016/066608, filed Jul. 13, 2016, which claims priority to German Patent Application No. DE 10 2015 213 293.5 filed Jul. 15, 2015, the entire contents of both of which are incorporated herein by reference.

FIELD

The present disclosure generally relates to devices and methods for executing remotely controlled underwater works, including an unmanned underwater vehicle that can perform underwater works via input from a remote control.

BACKGROUND

Owing to the increasing use of offshore resources, there is an increasing need to service or repair items of equipment located under water. Typical examples for the use of offshore resources are offshore wind parks, the extraction of mineral oil and natural gas, but also increasingly the extraction of other raw materials, for example ores. It is known that there are large reserves of raw materials located in the Arctic. Here, there is the additional problem that these regions are not free of ice all year round. It is therefore difficult to impossible to dispatch an underwater vessel that executes necessary works by means of a remotely operated vehicle (ROV).

An unmanned underwater vehicle is known from WO 2015/049678 A1, the unmanned underwater vehicle comprising a further unmanned underwater vehicle. However, the underwater vehicle described here is an underwater vehicle for, for example, mine clearance. The underwater vehicle is not designed for works that are often highly complex and that therefore regularly have to be performed by remote control.

A system for marine exploration is known from WO 2014/180590 A1. The system comprises a plurality of docks and an unmanned underwater vehicle. The system also has data communication to the land, but this is not equipped for the permanent transmission of data that would be necessary for remotely controlled underwater work.

Thus a need exists for an underwater vehicle that can autonomously control an item of equipment located, for example, beneath an ice cover, and that can perform works on the latter, the works being effected by remote control. This requires, in particular, reliable and powerful data transmission.

DETAILED DESCRIPTION

Figure 1:
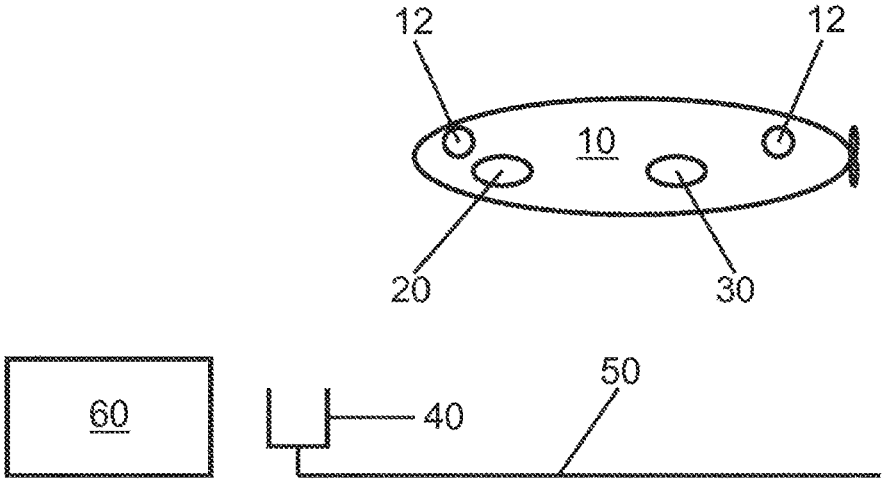
FIG. 1 is a schematic view of an example unmanned underwater vehicle traveling to an example underwater installation.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The unmanned underwater vehicle according to the invention comprises a remotely operated underwater vehicle and an autonomously operating underwater vehicle. The unmanned underwater vehicle comprises a first connection to the remotely operated underwater vehicle, wherein the first connection serves to exchange data. The unmanned underwater vehicle additionally comprises a second connection to the remotely operated underwater vehicle, wherein the second connection serves to supply energy. The unmanned underwater vehicle further has a third connection to the autonomously operating underwater vehicle, wherein the third connection serves to exchange data.

An advantage of the unmanned underwater vehicle according to the invention is the optimum exploitation of the advantages of the three vehicle types used. For the journey to the place of application, the unmanned underwater vehicle can preferably accommodate within itself the remotely operated underwater vehicle and the autonomously operating underwater vehicle. This enables an unmanned underwater vehicle of optimized streamlined design to be used. Generally, remotely operated underwater vehicles are constructed in such a way that they are not suitable for relatively large travel distances. Owing to their intended application, remotely operated underwater vehicles frequently comprise a plurality of manipulators (remotely operated tools). In order to be able to execute their work, remotely operated underwater vehicles are usually of a rather compact structure. Consequently, they are usually not of an optimized streamlined design, and not suitable for travelling large distances. With respect to their drive, they are usually optimized for maneuverability, and they do not normally have their own energy supply. The energy supply is effected by cable in parallel with the remote control. Remotely operated underwater vehicles thus cannot be used without a mother vehicle or carrier vehicle. Since the unmanned underwater vehicle must also be suitable for transporting the remotely operated underwater vehicle over large distances, it is difficult to connect it directly to an on-site interface, since the unmanned underwater vehicle cannot have the necessary maneuverability, owing to its practical focus. In particular, the unmanned underwater vehicle is comparatively large, to enable it to accommodate and transport the autonomously operating underwater vehicle and the remotely operated underwater vehicle. In addition, the unmanned underwater vehicle comprises energy storage and/or generating means, and a drive system for large distances. Consequently, the unmanned underwater vehicle is comparatively large and relatively unmaneuvrable. In order to establish the connection to an on-site interface, the unmanned underwater vehicle has an autonomously operating underwater vehicle. Autonomously operating underwater vehicles can perform simple tasks without further external control. In the present case, the task of the autonomously operating underwater vehicle, after having been released by the unmanned underwater vehicle, is to locate an on-site interface, head for the latter and establish a data connection. The autonomously operating underwater vehicle is thus more maneuverable than the considerably larger unmanned underwater vehicle. The autonomously operating underwater vehicle has a limited energy storage, which is sufficient for performing the assigned task. The energy storage of the autonomously operating underwater vehicle can be charged, for example, by the unmanned underwater vehicle while being transported in the latter.

Preferably, the unmanned underwater vehicle has a first interior storage space (first garage), in which the remotely operated underwater vehicle can be accommodated, and has a second interior storage space (second garage), in which the autonomously operating underwater vehicle can be accommodated. The interior storage renders an optimized streamlined design of the unmanned underwater vehicle.

The third connection serves to exchange data, this data exchange being effected ultimately between the remotely operated underwater vehicle and the site of remote operation. A direct data exchange, via the autonomously operating underwater vehicle, or with the autonomously operating underwater vehicle, is not required. The autonomously operating underwater vehicle serves merely to establish the data connection.

In a further embodiment of the invention, the autonomously operating underwater vehicle comprises a first interface, wherein the first interface is designed to exchange data with an item of underwater equipment. Preferably, the first interface is designed to be able to receive and send data electrically, acoustically or optically. An electrical interface preferably works without transmission of power. Particularly preferably, the data are transmitted acoustically or optically, since in this way it is possible to dispense with the use of electrical contacts in a corrosive environment. Particularly preferably, the interface is a glass-fiber plug-in connection. To enable works to be performed by remote control, it is necessary to establish, between the remotely operated underwater vehicle and a control center, a connection that in real time makes it possible, for example, to transmit image data of the remotely operated underwater vehicle to the control center, and in the opposite direction to transmit control commands from the control center to the remotely operated underwater vehicle. In the case of the usually very long connections, the data rates necessary for control can preferably be achieved by means of glass fiber technology. The control center may be at a great distance, in particular on land. The control center has technical equipment for communicating with the remotely operated underwater vehicle, communication being able to be effected directly or via the unmanned underwater vehicle. The control center may have devices for data acquisition, data analysis and/or data storage. The control center may have an operating means, via which the remotely operated underwater vehicle can be manually remotely operated. Alternatively or additionally, the control center may have a device for automatically controlling the remotely operated underwater vehicle. An advantage of this embodiment is the, in comparison with an autonomously operating underwater vehicle, considerably greater computing power that can be integrated into a control center. For example, data storage can be effected for the purpose of documentation and/or preservation of evidence.

In a further embodiment of the invention, the autonomously operating underwater vehicle comprises at least one first sensor, wherein the first sensor serves to autonomously navigate the autonomously operating underwater vehicle, wherein the first sensor is an acoustic sensor or an optical sensor. Since the function of the autonomously operating underwater vehicle consists in finding an on-site interface and establishing a connection to the latter, the autonomously operating underwater vehicle requires a sensor suitable for this purpose. Preferably, for the purpose of navigation, an acoustically based orientation system, for example a sonar, may be used. Alternatively or additionally, however, visual navigation may be effected, in which case for this purpose the autonomously operating underwater vehicle comprises a light source, besides a camera as a sensor.

In a further embodiment of the invention, the first connection and the second connection are realized in a common connection strand, for example in a multi-core cable. It is likewise possible that both energy supply and data exchange are effected via the same mechanical cable, as is known, for example, from the use of electric leads for a LAN.

In a further embodiment of the invention, the unmanned underwater vehicle comprises a first cable management system for the first connection and the second connection, and a second cable management system for the third connection. Whereas the underwater vehicle usually holds its position in the field of operation, the remotely operated underwater vehicle will change its position frequently to enable it to perform its work. Between the unmanned underwater vehicle and the remotely operated underwater vehicle are the first connection and the second connection. Owing to the changing relative position of the remotely operated underwater vehicle in relation to the unmanned underwater vehicle, this advantageously is tracked in an active manner. In the simplest case, this can be effected by winding up the connections. Since, likewise, the distance between the unmanned underwater vehicle and the autonomously operating underwater vehicle is dependent on the respective situation, active tracking is also preferred here for the third connection.

In a further embodiment of the invention, the unmanned underwater vehicle comprises an energy generating device. Preferably, the energy generating device is a fuel cell or a diesel generator that is non-dependent on external air. The use of a fuel cell or a diesel generator that is non-dependent on external air makes it possible to achieve very high storage densities. Since the unmanned underwater vehicle is to be designed, in particular, also for use under a closed ice cover, systems that are non-dependent on external air are advantageous, since no oxygen, or combustion air, can be made available from the surface, e.g. through a snorkel.

In a further embodiment of the invention, the unmanned underwater vehicle comprises an energy storage means. It is also possible for the unmanned underwater vehicle to comprise, as a single energy source, for example a battery or power pack. It is usual and preferred, however, that the energy storage means is present in parallel with an energy generating device. Particularly preferably, a combination of a fuel cell and a power pack is used. The fuel cell can thereby be operated at a continuous energy generating level, with load peaks during the use of the remotely operated underwater vehicle being absorbed by means of the energy storage means.

In a further embodiment of the invention, the unmanned underwater vehicle comprises a dynamic positioning system. It is also conceivable for the unmanned underwater vehicle to hold its position, for example, by means of an anchor. Since, however, there are generally underwater installations present in the area of application, it is preferred that an anchor is not used, in order to avoid damage to the underwater installations. In order nevertheless to hold the position, the unmanned underwater vehicle comprises a dynamic positioning system that consists, preferably, of a plurality of thruster drives, which may also be swivellable. The thruster drives may be controlled and swiveled individually for positioning tasks. The dynamic positioning system may be designed, for example, so as to be independent of the main drive system for large distances, this having the advantage that both systems can be independently optimized to the respective intended purpose.

In an additional or alternative embodiment, the at least one connection between the unmanned underwater vehicle and the autonomously operating underwater vehicle is realized to be of such stability that usual loads of an anchorage on the ground can be transmitted without damage to the connection, and the autonomously operating underwater vehicle comprises means for effecting a load-bearing connection to an underwater installation, in particular this underwater installation is an interface for a data connection. Alternatively, the autonomously operating underwater vehicle may have anchor means. As a result of this design, the autonomously operating underwater vehicle can perform the additional task of securing the position of the underwater vehicle.

In a further embodiment of the invention, the unmanned underwater vehicle comprises a data processing means, to enable the communication signals arriving from the control center to be decoded, decompressed and/or amplified. Alternatively or additionally, the unmanned underwater vehicle comprises a data processing means, to enable the communication signals that are to be sent by the remotely operated underwater vehicle to be encoded, compressed and/or amplified. In the case of coded and/or compressed data transmission, the control center has a corresponding device for encoding and/or decoding, and for compressing and/or decompressing. The data processing means of the unmanned underwater vehicle may also alter the type of data transmission. For example, the type of data transmission between the unmanned underwater vehicle and the remotely operated underwater vehicle may be electrical, and the data transmission between the unmanned underwater vehicle and the control center may be effected optically.

In a further embodiment of the invention, the unmanned underwater vehicle has a control unit, the control unit being able to remotely control the remotely operated underwater vehicle. The control unit may be used to remotely control the remotely operated underwater vehicle if the data transmission to the control center is interrupted or subject to interference. Preferably, the control unit serves to perform rudimentary operations, for example to bring the remotely operated underwater vehicle into a safe position or to return it to the unmanned underwater vehicle in the case of interruption of the remote control by the control center. Likewise, the remotely operated underwater vehicle can be held in its position by the control unit of the unmanned underwater vehicle until the connection to the control center has been restored.

In a further embodiment of the invention, the control unit of the unmanned underwater vehicle may be designed to autonomously perform control tasks for particular work operations. For example, simple tasks, or routine tasks, of the remotely operated underwater vehicle may be performed autonomously by the control unit of the unmanned underwater vehicle without interaction with the control center. For example, the task of laying a cable from a first point to a second point could be transmitted from the control center to the unmanned underwater vehicle. In this case, the control unit of the unmanned underwater vehicle would autonomously remotely control the remotely operated underwater vehicle and process the task. An advantage of this embodiment is the significant reduction of the data transmission to the control center. On the other hand, a conventional remotely operated underwater vehicle, which does not require an autonomous working capability, can continue to be used.

In a further embodiment of the invention, the third connection is realized as a pure data transmission connection. For example, it is a glass fiber connection.

In a further embodiment of the invention, the unmanned underwater vehicle, the autonomously operating underwater vehicle and the remotely operated underwater vehicle are supplied with energy exclusively by the unmanned underwater vehicle. An advantage of this embodiment is that the connection line to the control center operates practically without power. This renders possible a comparatively simple embodiment, optimized to data transmission.

In a further embodiment of the invention, the unmanned underwater vehicle comprises at least one first remotely operated underwater vehicle and at least one second remotely operated underwater vehicle. Also conceivable are embodiments having three or more remotely operated underwater vehicles. In this case, the several remotely operated underwater vehicles may be of the same type. This enables tasks to be performed in parallel, and therefore more rapidly overall. On the other hand (alternatively or additionally), differing remotely operated underwater vehicles may be used, in which case the differing remotely operated underwater vehicles may be optimized for differing tasks. The respective remotely operated underwater vehicle to be used for a task is selected according to the specialization.

In a further aspect, the invention relates to a system for the execution of remotely controlled underwater works, wherein the system for the execution of remotely controlled underwater works consists of an unmanned underwater vehicle according to the invention, a control center, a connection line between the control center and a location at which the remotely controlled underwater works are to be performed. The connection line comprises a second interface at the underwater end, wherein the second interface is designed to exchange data with a first interface of the autonomously operating underwater vehicle of the unmanned underwater vehicle. The control center is preferably land-based.

The system according to the invention renders possible complex underwater works that can be performed by remote control. The advantage of a fixed connection line between the (preferably land-based) control center and the area of application is, firstly, a comparatively high data transmission rate. On the other hand, a fixedly laid connection line is significantly more secure than a one-time connection laid by the unmanned underwater vehicle. Such one-time connections are usually very thin glass fibers that may be used, for example, in the remote control of torpedoes. However, they are liable to damage, and are normally only suitable for short-term use. Furthermore, in the case of underwater extraction of raw materials, the installations are in use over a very long period of time, such that servicing or repair measures normally have to be performed within the service life of the installations. The one-time laying thus also enables cost savings to be made.

In a further aspect, the invention relates to a method for the execution of remotely controlled underwater works. The method comprises the following method steps:

a) dispatching an unmanned underwater vehicle according to the invention to the location at which the remotely controlled underwater works are to be performed, b) decoupling the autonomously operating underwater vehicle from the unmanned underwater vehicle, c) the autonomously operating underwater vehicle autonomously heading for a second interface, d) establishing a connection between a first interface and the second interface, e) setting up a data connection between the control center and the remotely operated underwater vehicle, f) executing the underwater works by means of the remotely operated underwater vehicle.

In step a), the unmanned underwater vehicle first travels autonomously into the area of operation. In this case, preferably, the remotely operated underwater vehicle and the autonomously operating underwater vehicle are inside the unmanned underwater vehicle.

After the unmanned underwater vehicle has reached the area of operation, in step b) the autonomously operating underwater vehicle is decoupled.

In step c), the autonomously operating underwater vehicle autonomously heads for the second interface. Particularly preferably, in this case there is communication between the second interface and the autonomously operating underwater vehicle, for example the autonomously operating underwater vehicle emits a first acoustic signal, which has the result that the acoustic remote terminal at the second interface emits a second acoustic signal, and thus enables the autonomously operating underwater vehicle to navigate.

In step d), a connection is established between the first interface and the second interface. Preferably, a mechanical connection is also established between the autonomously operating underwater vehicle and the second interface, in order to anchor the autonomously operating underwater vehicle to the second interface. The establishing of the connection for data exchange may be effected, for example, by a plug-in connection. Alternatively, however, the establishing of the connection may also be effected by the exchange of acoustic signals or light signals.

Following establishment of this connection, in step e) a connection is established from the control center, via the unmanned underwater vehicle, to the remotely operated underwater vehicle.

In step f), the remotely controlled underwater works are then executed. In this case, the unmanned underwater vehicle performs the function of supplying energy to the remotely operated underwater vehicle, while control is effected by the control center. As a result, even protracted and highly complex works are possible.

Figure 2:
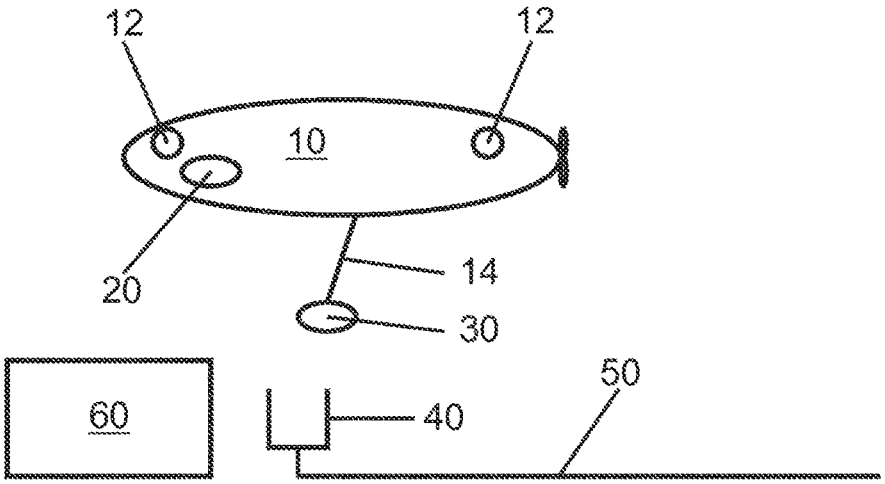
FIG. 2 is a schematic view of an example operating underwater vehicle heading autonomously for a second interface.
Figure 3:
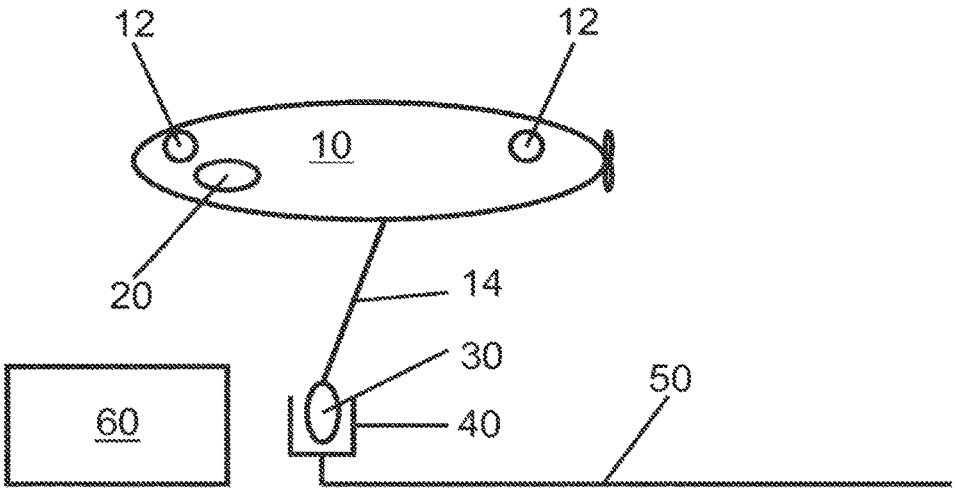
FIG. 3 is a schematic view showing a connection being established between a first interface and a second interface.
Figure 4:
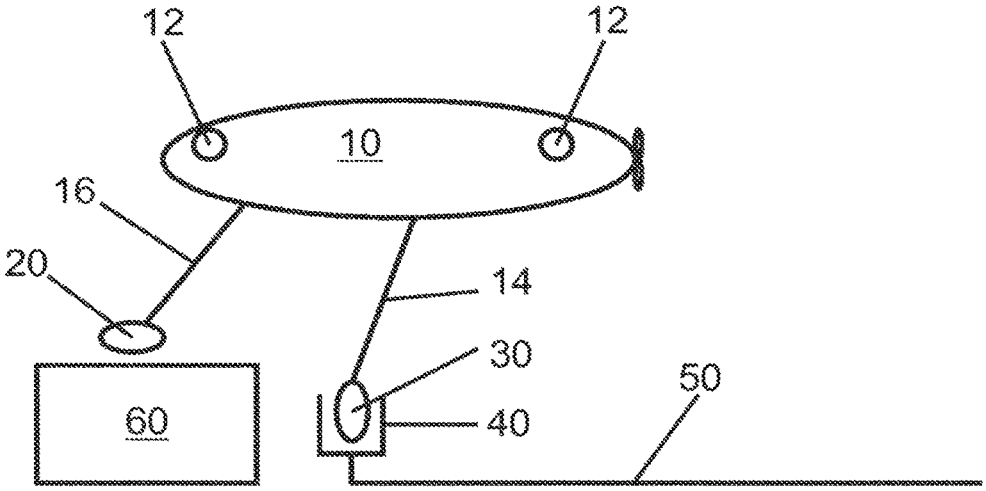
FIG. 4 is a schematic view of the execution of the remotely controlled underwater works.

For the purpose of servicing an underwater installation 60, an unmanned underwater vehicle 10 is dispatched thereto, as represented in FIG. 1. The unmanned underwater vehicle 10 comprises an remotely operated underwater vehicle 20 and an autonomously operating underwater vehicle 30. After the destination area has been reached, the autonomously operating underwater vehicle 30 is decoupled from the unmanned underwater vehicle 10. The autonomously operating underwater vehicle 30 then autonomously heads for the second interface 40, as represented in FIG. 2, and establishes a connection, as shown in FIG. 3. A connection can now be set up from the control center to the remotely operated underwater vehicle 20, via the connection line 50, the second interface 40, the autonomously operating underwater vehicle 30, the third connection 14, the unmanned underwater vehicle 10 and the first connection 16. The remotely operated underwater vehicle 20 is then controlled via this connection and, as shown in FIG. 4, the underwater works are executed at the underwater installation 60. In order that the unmanned underwater vehicle 10 can hold its position in the region of the underwater installation 60, it comprises a dynamic positioning system 12.

Following completion of the underwater works, the remotely operated underwater vehicle 20 returns to the unmanned underwater vehicle 10, the connection between the second interface 40 and the autonomously operating underwater vehicle 30 is undone, and also the autonomously operating underwater vehicle 30 returns to the unmanned underwater vehicle 10. The unmanned underwater vehicle 10 can travel to its point of departure or to another deployment location.

REFERENCES

10 unmanned underwater vehicle
12 dynamic positioning system
14 third connection
16 first and second connection
20 remotely operated underwater vehicle
30 autonomously operating underwater vehicle
40 second interface
50 connection line
60 underwater installation

What is claimed is:

1. An unmanned underwater vehicle system, comprising:

an unmanned underwater vehicle (UUV) that is free from any connection to a surface vessel and is configured to autonomously travel to an underwater work site of operation;

a remotely operated underwater vehicle (ROUV) coupled to the UUV by both of a first connection and a second connection, the second connection being configured to supply energy from the UUV to the ROUV; and an autonomously operating underwater vehicle (AOUV) coupled to the UUV by a third connection, the AOUV comprising:

a first sensor configured to cause the AOUV to autonomously navigate to an on-site interface of an underwater connection line that is hardwired to a land-based control center, and a first interface configured to autonomously be placed in operative communication with, and establish a data connection with, the on-site interface of the underwater connection line so as to permit data to be exchanged between the land-based control center and the ROUV, wherein the first connection from the ROUV to the UUV, and the third connection from the UUV to the AOUV, are together configured to permit the exchange of data between the ROUV and the on-site interface of the underwater connection line.

2. The unmanned underwater vehicle system of claim 1, wherein the first interface is configured to send and receive data electrically, acoustically, or optically.

3. The unmanned underwater vehicle system of claim 1 wherein the autonomously operating underwater vehicle comprises a first sensor configured to autonomously navigate the autonomously operating underwater vehicle, wherein the first sensor is an acoustic sensor or an optical sensor.

4. The unmanned underwater vehicle system of claim 1 further comprising:

a first cable management system for the first and second connections; and a second cable management system for the third connection.

5. The unmanned underwater vehicle system of claim 1 further comprising an energy generating device.

6. The unmanned underwater vehicle system of claim 5 wherein the energy generating device is a fuel cell or a diesel generator that is non-dependent on external air.

7. The unmanned underwater vehicle system of claim 1 further comprising an energy storage means.

8. The unmanned underwater vehicle system of claim 1 further comprising a dynamic positioning system.

9. The unmanned underwater vehicle system of claim 1 wherein the third connection is configured as a pure data transmission connection.

10. The unmanned underwater vehicle system of claim 1 wherein the autonomously operating underwater vehicle and the remotely operated underwater vehicle are supplied with energy exclusively by the unmanned underwater vehicle.

11. A system for execution of remotely controlled underwater works, the system comprising:

an unmanned underwater vehicle configured to autonomously travel to an underwater work site at which the remotely controlled underwater works are to be performed, the unmanned underwater vehicle including, a remotely operated underwater vehicle configured to perform remotely controlled underwater work, an autonomously operating underwater vehicle having a first interface configured to establish a data connection, a first connection extending from the unmanned underwater vehicle to the remotely operated underwater vehicle and configured to permit data exchange with the remotely operated underwater vehicle, a second connection extending from the unmanned underwater vehicle to the remotely operated underwater vehicle and configured to supply energy to the remotely operated underwater vehicle, and a third connection extending from the unmanned underwater vehicle to the first interface of the autonomously operating underwater vehicle, third connection being in operative communication with both of the first connection and the remotely operated underwater vehicle and configured to permit data exchange from the remotely operated underwater vehicle to the first interface;

a control center configured to provide operating instructions to the remotely operated underwater vehicle; and a connection line having a first end in operative communication with the control center, and an opposing second end comprising a second interface disposed at the underwater work site, wherein, the autonomously operating underwater vehicle is configured to autonomously navigate to the second interface after the unmanned underwater vehicle arrives at the underwater work site, and wherein the second interface is configured to establish a data connection with the first interface of the autonomously operating underwater vehicle, so as to permit the exchange of data between the control center and the remotely operated underwater vehicle, through each of the connection line, the second interface, the first interface of the autonomously operating underwater vehicle, the third connection, and the first connection.

12. A method for executing remotely controlled underwater works, the method comprising:

dispatching an unmanned underwater vehicle that is free from any physical connection to a surface vessel to autonomously navigate to an underwater work site at which the remotely controlled underwater works are to be executed, the unmanned underwater vehicle including, a remotely operated underwater vehicle coupled to the unmanned underwater vehicle by both of a first connection configured exchange data with the remotely operated underwater vehicle, and a second connection configured to supply energy to the remotely operated underwater vehicle, an autonomously operating underwater vehicle coupled to the unmanned underwater vehicle by a third connection that is configured to exchange data with the remotely operated underwater vehicle through the first connection, and an energy storage means;

releasing the autonomously operating underwater vehicle from the unmanned underwater vehicle so that it is separately navigable from the unmanned underwater vehicle;

autonomously navigating the autonomously operating underwater vehicle to a second interface of an underwater communication line connected to a control center;

establishing a connection between a first interface of the autonomously operating underwater vehicle and the second interface, after the autonomously operating underwater vehicle autonomously arrives at the location of the second interface;

setting up a data connection between the control center and the remotely operated underwater vehicle through the respective connections between each of the communication line, the second interface, the first interface, the third connection, and the first connection; and executing the remotely controlled underwater works by sending control signals from the control center through the established data connection to the remotely operated underwater vehicle, for execution by the remotely operated underwater vehicle.

* * * * *